US008122558B1

(12) United States Patent
Gary et al.

(10) Patent No.: US 8,122,558 B1
(45) Date of Patent: Feb. 28, 2012

(54) PERSONAL HYGIENE DEVICE

(76) Inventors: Maedell Gary, Grants, NM (US); Gloria Cothern, Grants, NM (US)

( * ) Notice: Subject to any disclaimer, the term of this patent is extended or adjusted under 35 U.S.C. 154(b) by 1045 days.

(21) Appl. No.: 12/031,578

(22) Filed: Feb. 14, 2008

(51) Int. Cl.
*A47K 7/08* (2006.01)

(52) U.S. Cl. ..... 15/210.1; 134/6; 604/1

(58) Field of Classification Search ..... 15/104.94, 15/210.1; 604/1; 134/6
See application file for complete search history.

(56) References Cited

U.S. PATENT DOCUMENTS

| | | | | |
|---|---|---|---|---|
| 5,875,512 | A * | 3/1999 | Lathan | 15/210.1 |
| 6,158,077 | A * | 12/2000 | Wenger et al. | 15/210.1 |
| 6,269,516 | B1 * | 8/2001 | Saatjian et al. | 15/210.1 |
| 6,272,716 | B1 * | 8/2001 | Thornton | 15/210.1 |
| 7,249,392 | B1 * | 7/2007 | Paille | 15/210.1 |

* cited by examiner

*Primary Examiner* — Mark Spisich
(74) *Attorney, Agent, or Firm* — Michael I. Kroll

(57) ABSTRACT

A means for a physically challenged user to gain access to their anus in order to clean the area through a wiping action. The device has a handle that operates through a positionable mid-section to a pair of spreader elements used to spread the cheeks of the buttocks while a wiping element covered by a sleeve is brought forward through leverage, wherethen while holding the handle wiping can be performed through repetitive parallel movement of the device.

14 Claims, 12 Drawing Sheets

PERSONAL HYGIENE DEVICE

BACKGROUND OF THE INVENTION

1. Field of the Invention

The present invention relates generally to personal hygiene and, more specifically, to a device with an operable handle and positional midsection having spreading elements for spreading the cheeks of one's buttocks to gain access to ones anus wherethen a wiping element having a disposable sleeve is moved forward between said spreading elements in order to be rubbed in a wiping action across said anus to clean the area after defecation. Comprising the device in a positional mid section containing a flexible displacement element attached to a handle that is depressed to transfer downward force through said displacement element on to a pivot point having a plurality of linkages wherethen if force is applied, said force causes the spreader elements to transverse outward in a spreading action meanwhile simultaneously having a set of hinged elements and linkage utilized through the same downward displacement and lever action to bring the wiping element forward to perform a cooperating wiping and spreading function. Additionally the present invention allows for the easy change and replacement of sleeves that fit over the wiping element by use of slipping a sleeve onto the element for use and removing said sleeve after use by utilizing a tab that may be manipulated downward to slide said sleeve off the element for contact free disposal.

The device can also be used to push out dry fecal matter by appropriately positioning the spreading elements around the anus or by placing lubricant on one spreading element and inserting into the anus to moisten dried material for evacuation.

2. Description of the Prior Art

There are other wiping devices designed for wiping ones anus. Typical of these is U.S. Pat. No. 1,818,388 issued to Farley on Aug. 11, 1931

Another patent was issued to Leonard et al. on Jan. 11, 1966 as U.S. Pat. No. 3,228,398. Yet another U.S. Pat. No. 4,075,033 was issued to Knox et al. on Feb. 21, 1978 and still yet another was issued on Sep. 3, 1991 to Tetrault as U.S. Pat. No. 5,044,040.

Another patent was issued to Steffen et al on Oct. 22, 1996 as U.S. Pat. No. 5,566,418. Yet another U.S. Pat. No. 6,058,524 was issued to Deveer on May 9, 2000. Another was issued to Saatjian et al. on Aug. 7, 2001 as U.S. Pat. No. 6,269,515 and still yet another was issued on Feb. 10, 2004 to Hillman as U.S. Pat. No. 6,689,224.

Another patent was issued to Paille on Jul. 31, 2007 as U.S. Pat. No. 7,249,392. Yet another British Patent No. GB2237981 was issued to Feldmann on Nov. 13, 1989. Another was issued to Wenger on Jul. 6, 2000 as PCT Patent No. WO00/38563 and still yet another was issued on Sep. 20, 2006 to Buckingham as British Patent No. GB2424173.

U.S. Pat. No. 1,818,388

Inventor: L. L. Farley

Issued: Aug. 11, 1931

A cleansing device comprising a hollow head having perforations in the upper face thereof, a conduit having a portion extending downwards therefrom and a portion extending angularly upwards from the lower end of the first mentioned portion, there being a passageway through said conduit to the interior of said head, and means for connecting said conduit to a source of water under pressure.

U.S. Pat. No. 3,228,398

Inventor: T. M. Leonard et al.

Issued: Jan. 11, 1966

A vaginal cleansing instrument comprising an elongated handle formed into a stem at one end, a cylindrical sponge adapted to be inserted into and having the size and shape to fit within the vagina surrounding said stem and fixed to said stem, the cylindrical surface of said sponge conforming to the surface traced by one side of a rectangle revolved around the parallel side as an axis an integral compressed mass of said sponge separate from the main body of said sponge being permanently formed internally within said sponge, attached to the main body of said sponge at one point, aid positioned over the end of and adjacent to said stem, the portion of said sponge adjacent the external surface of said sponge being uncompressed.

U.S. Pat. No. 4,075,033

Inventor: Michael A. Knox et al

Issued: Feb. 21, 1978

A wiping material in the shape of a cup and a handle for holding the material during its use. The wiping material may include several layers with the same or different compositions. For hygienic use, it may have a layer of soft, absorbent toilet paper with, perhaps, an innermost layer of a moisture impermeable material. The handle typically fits inside of and grasps onto the cup-shaped wipe. Conveniently, a compressible sponge on the end of the handle and slightly larger than the inside of the wiping material retains the material for use. The handle may also eject the wipe after such use. A plunger connects to a shaft in the handle which in turn connects to a washer or some other surface near the sponge. Depressing the plunger moves the cone of material off the sponge where it may fall into some receptacle. A spring within the handle biases the plunger and shaft back into its former position. Utilizing the combination involves placing the handle next to the cone of material and connecting the two together. Moving the handle then allows the web of material to contact and treat the desired surface. Subsequently, the web disengages from the handle, preferably without contacting the wiping material itself.

U.S. Pat. No. 5,044,040

Inventor: Lise Tetrault

Issued: Sep. 3, 1991

A toileting assist device for a patient wearing a back brace or having other body limitations causing inability to reach sufficiently to perform the toileting function, including a base member upon which a removable cleansing fabric is wrapped and an integral handle extending at an obtuse angle from one end of the base member. The length of the handle and the angle thereof relative to the base member are such that the patient, while sitting on a toilet, can reach the anatomical areas to be wiped without bending or moving the torso laterally.

U.S. Pat. No. 5,566,418

Inventor: Steffen et al

Issued: Oct. 22, 1996

An improved lotion applicator comprises an extendable arm and an applicator member affixed to the extendable arm. A person can grip the extendable arm opposite from the applicator member, to reach the back and hard to reach areas of the body with the applicator member for applying lotion thereto.

U.S. Pat. No. 6,058,524

Inventor: William B. Deveer

Issued: May 9, 2000

The process of the use of a bidet and an antiseptic brush in combination with an anti-viral, anti-bacterial, skin cleanser, leads to an antisepsis of the anal area of the buttocks. This process could reduce risk of serious disease such as meningitis, hepatitis and many other diseases that may lead to loss of life.

U.S. Pat. No. 6,269,515

Inventor: Saatjian et al

Issued: Aug. 7, 2001

A waste remover of human waste is disclosed. The waste remover comprises a remover member and a moveable member. The moveable member is located in a tube. The tube is also coupled to a head. A remover member extends from the head.

U.S. Pat. No. 6,689,224

Inventor: Rosemary Hillman

Issued: Feb. 10, 2004

An implement used for personal hygiene by an obese or impaired person includes an elongated handle having a curving blade covered with an absorbent wiping cover, stroked by the user gripping the handle with the covered blade pressed against the person's anal-genital body regions.

U.S. Pat. No. 7,249,392

Inventor: Michel G. Paille

Issued: Jul. 31, 2007

A self wiping toiletry device and method of use which utilizes a jaw system and release button to hold and release toilet paper for wiping. The apparatus and method is especially useful for handicapped persons and those having limited use of one or both hands. The apparatus and method in its preferred form easily allows a person to roll toilet paper, install the rolled paper into the jaw system, use the rolled paper to wipe after toilet use, and thereafter easily dispense the soiled paper into the toilet water.

U.K. Patent Number GB2237981

Inventor: Alexander Feldmann

Issued: May 22, 1991

An anal wiping implement comprises a handle 1 having a free end portion 2 adapted to receive at least one disposable cap. The cap, which may be generally conical in shape, may have a soft toilet paper texture on its exterior surface.

International Patent Application Number WO 00/38563

Inventor: William Wenger

Published: Dec. 23, 1998

A personal hygiene appliance extension handle (11) for persons having limited hand reach or body mobility which has a grasping means for holding toilet tissue and functions as a hand extension to permit cleansing of the perineal area.

U.K. Patent Number GB2424173

Inventor: Simon John Buckhgham

Issued: Sep. 20, 2006

The invention relates to a personal hygiene wiper 1. Wiper 1 has a wiper shaft 2 having a handle at one end 3 and a support member 5 at the other end. A flexible sock 6 fits over the support member 5. Sock 6 has a wiping face 7 and an integral pocket 8 remote from the wiping face. Inverting means 12 is provided to invert the pocket. In use toilet paper can be placed over the sock wiping face 7 and the ends of the paper tucked into the pocket 8 to hold the paper on the sock and the paper used to clean a person. The paper can then be released into a toilet bowl for disposal by inverting the pocket using said inverting means so releasing the ends of the paper.

While these hygiene devices may be suitable for the purposes for which they were designed, they would not be as suitable for the purposes of the present invention, as hereinafter described.

SUMMARY OF THE PRESENT INVENTION

A primary object of the present invention is to provide a personal hygiene device having a handle that operates a pair of spreaders that work in cooperation with an elongated wiping element to allow a disabled or handicapped person to easily wipe and clean their anus.

Another object of the present invention is to provide a personal hygiene device having a pair of spreaders utilized for gaining access and spreading the cheeks of one's buttocks.

Yet another object of the present invention is to provide a personal hygiene device having a positionable midsection whereby a user may bend the device at any angle that best suits reaching the buttocks.

Still yet another object of the present invention is to provide a personal hygiene device having a pair of spreaders that cooperate with a displacement element operated by a squeezable handle to create a motion through linkages whereby a spreading motion and forward displacement of the wiping element occur simultaneously.

Another object of the present invention is to provide a personal hygiene device having disposable sleeves that are placed over the wiping element and then after use are easily removed utilizing a slide mechanism that pushes the used sleeve off.

Yet another object of the present invention is to provide a personal hygiene device having means for preventing the buttock's cheeks from contacting the wiping element while in use.

Still yet another object of the present invention is to provide a personal hygiene device that can be used to displace dried fecal material through appropriate placement of the spreading elements in various perineal positions.

Still yet another object of the present invention is to provide a personal hygiene device having a locking mechanism to lock the handle and respective spreaders in a desired open position to make manipulation of the device easier.

Another object of the present invention is to provide a personal hygiene device having a fecal barrier utilized to prevent the spread of fecal matter from one's anus to one's genitals while performing a sweeping or wiping procedure.

Yet another object of the present invention is to provide a personal hygiene device whereby one spreader element may be lubricated and placed inside of the anus and up into the colon to moisten hardened material for evacuation.

Additional objects of the present invention will appear as the description proceeds.

The present invention overcomes the shortcomings of the prior art by providing a means for a physically challenged user to gain access to their anus in order to clean the area through a wiping action. The device has a handle that operates through a positionable midsection to a pair of spreader elements used to spread the cheeks of the buttocks while a wiping element covered by a sleeve is brought forward through leverage, wherethen while holding the handle wiping can be performed through repetitive parallel movement of the device.

Additional sleeves are provided that fit over the wiping element, after use the sleeve is easily removed via a sliding tab that is slid to push the sleeve off the wiping element for sanitary disposal.

Furthermore, the device can be used as a tool, by lubricating to place inside colon to soften hardened stool or use both elements to push around on outside of anus to help in removing bunched hardened stool.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
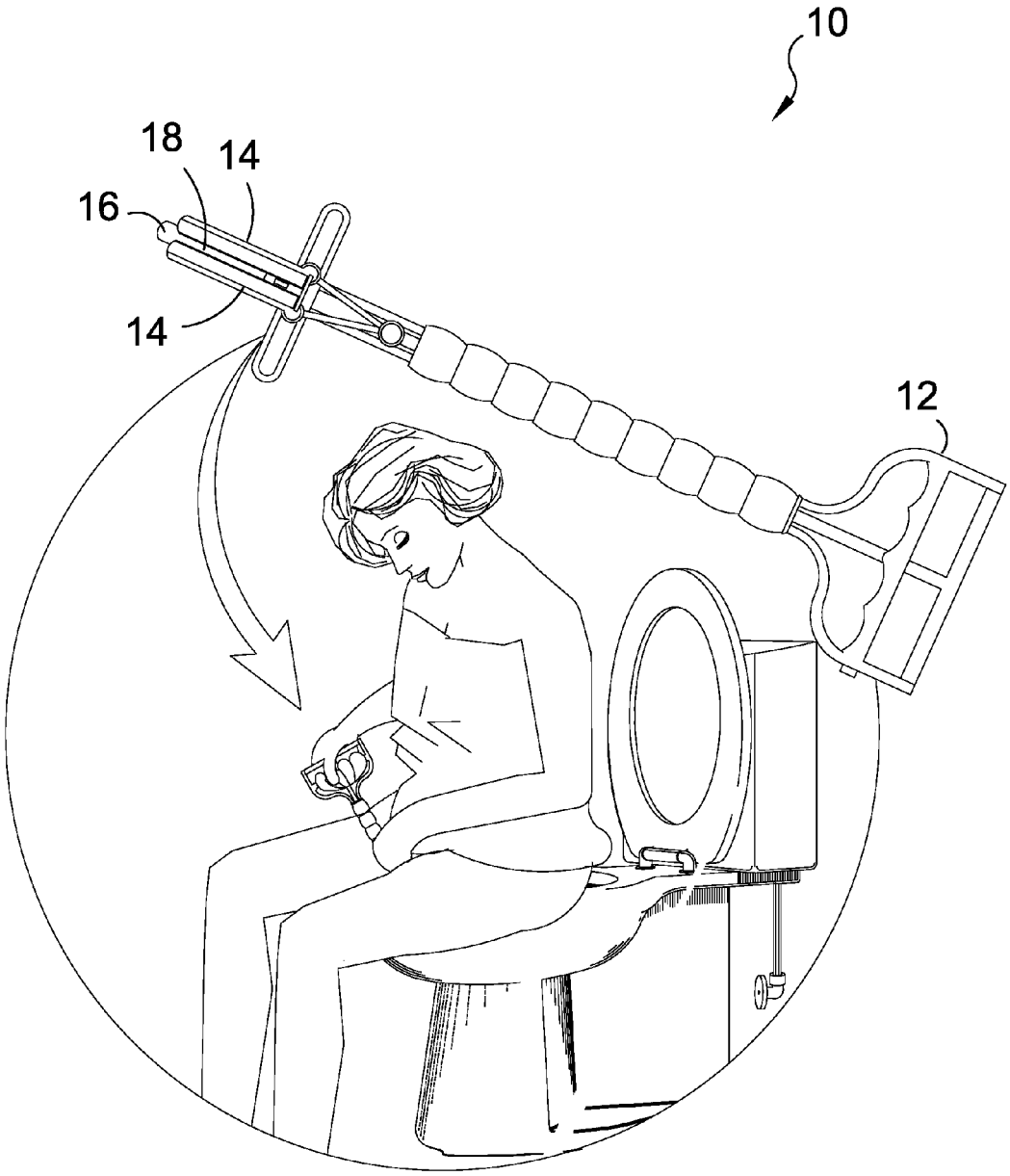
FIG. 1 is an illustrative view of the present invention in use.

Turning now descriptively to the drawings, in which similar reference characters denote similar elements throughout the several views, the figures illustrate the Personal Hygiene Device of the present invention. With regard to the reference numerals used, the following numbering is used throughout the various drawing figures.

10 Personal Hygiene Device of the present invention
12 handle
14 spreader
16 wiper element
18 disposable wiper sleeve
22 pivot point
24 linkage
26 displacement element
28 handle lock
30 positionable mid-portion
32 fecal barrier
34 linkage track
38 spreader linkage
40 wiper linkage
42 buttock
44 slidable sleeve removal tab
46 storage case
48 sleeve storage pocket

DETAILED DESCRIPTION OF THE PREFERRED EMBODIMENT

The following discussion describes in detail one embodiment of the invention. This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the present invention 10 in use. The present invention is a personal hygiene device 10 for wiping the anus comprising an extender incorporating means for spreading the buttocks and means for wiping the anus. The personal hygiene device has a handle 12 in communication with the means for spreading 14 the buttocks and a holder 16 for a disposable wipe 18 positioned approximate the means for spreading the buttocks.

Figure 2:
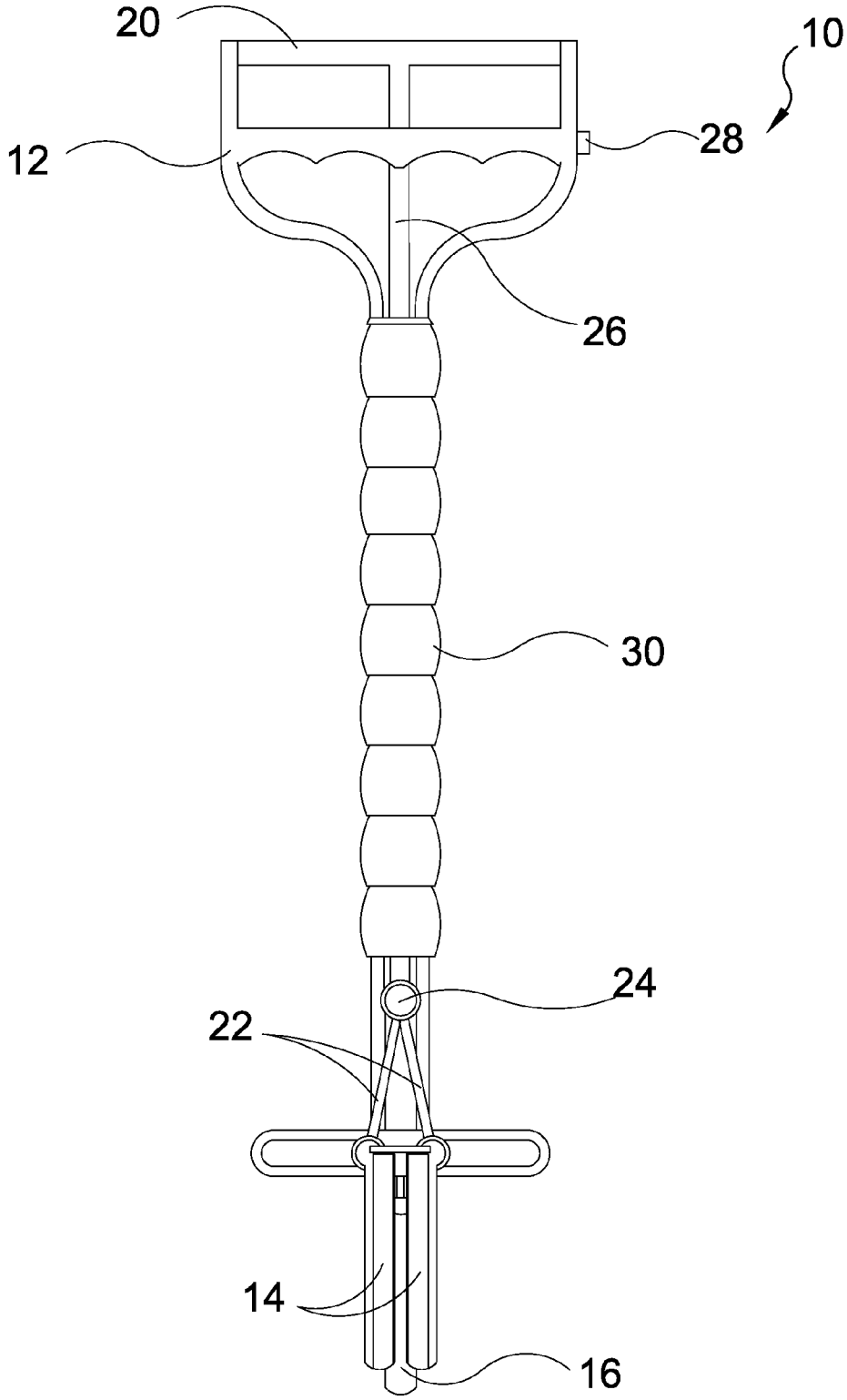
FIG. 2 is a front view of the present invention.

FIG. 2 is a front view of the present invention 10. Shown is the present invention 10 having a stationary handle 12, a displacement handle 20 that when depressed in respect to the stationary handle 12 acts upon a pivot point 22 and related linkage 24 to separate the spreader elements 14 and initiate a simultaneously forward movement of the elongated wiping element 16. A displacement element 26 communicates through a positionable midportion 30 between the displacement handle 20 and the linkage 24. A handle lock 28 is provided to maintain the displacement handle 20 in the operative position.

Figure 3:
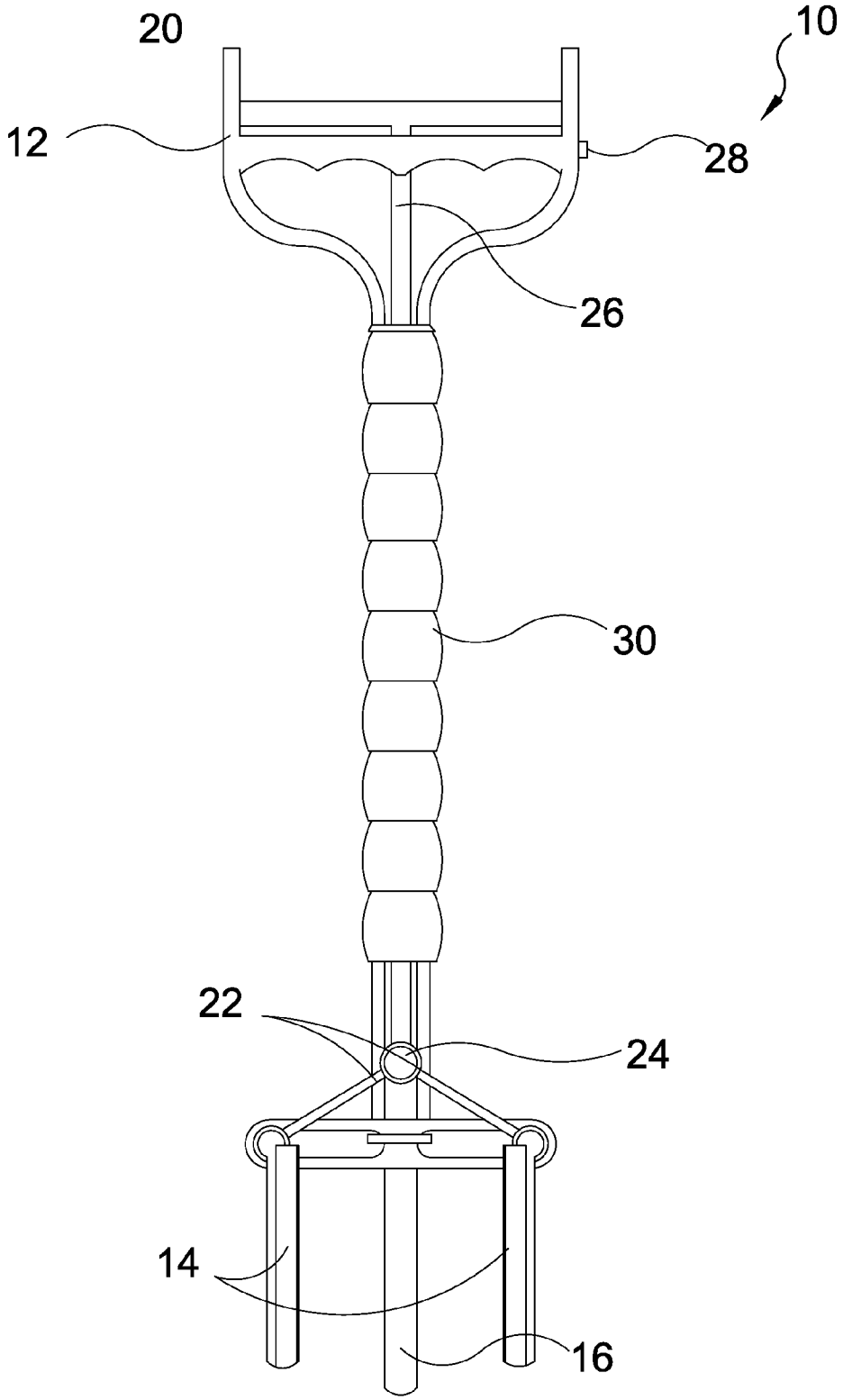
FIG. 3 is a front view of the present invention.

FIG. 3 is a front view of the present invention 10. Shown is the present invention 10 having a stationary handle 12 with the displacement handle 20 depressed in respect to the displacement handle 20 and acting upon a pivot point 22 and related linkage 24 to separate the spreader elements 14 and initiate a simultaneously forward movement of the elongated wiping element 16. A displacement element 26 communicates through a positionable midportion 30 between the displacement handle 20 and the linkage 24. A handle lock 28 is provided to maintain the displacement handle 20 in the operative position.

Figure 4:
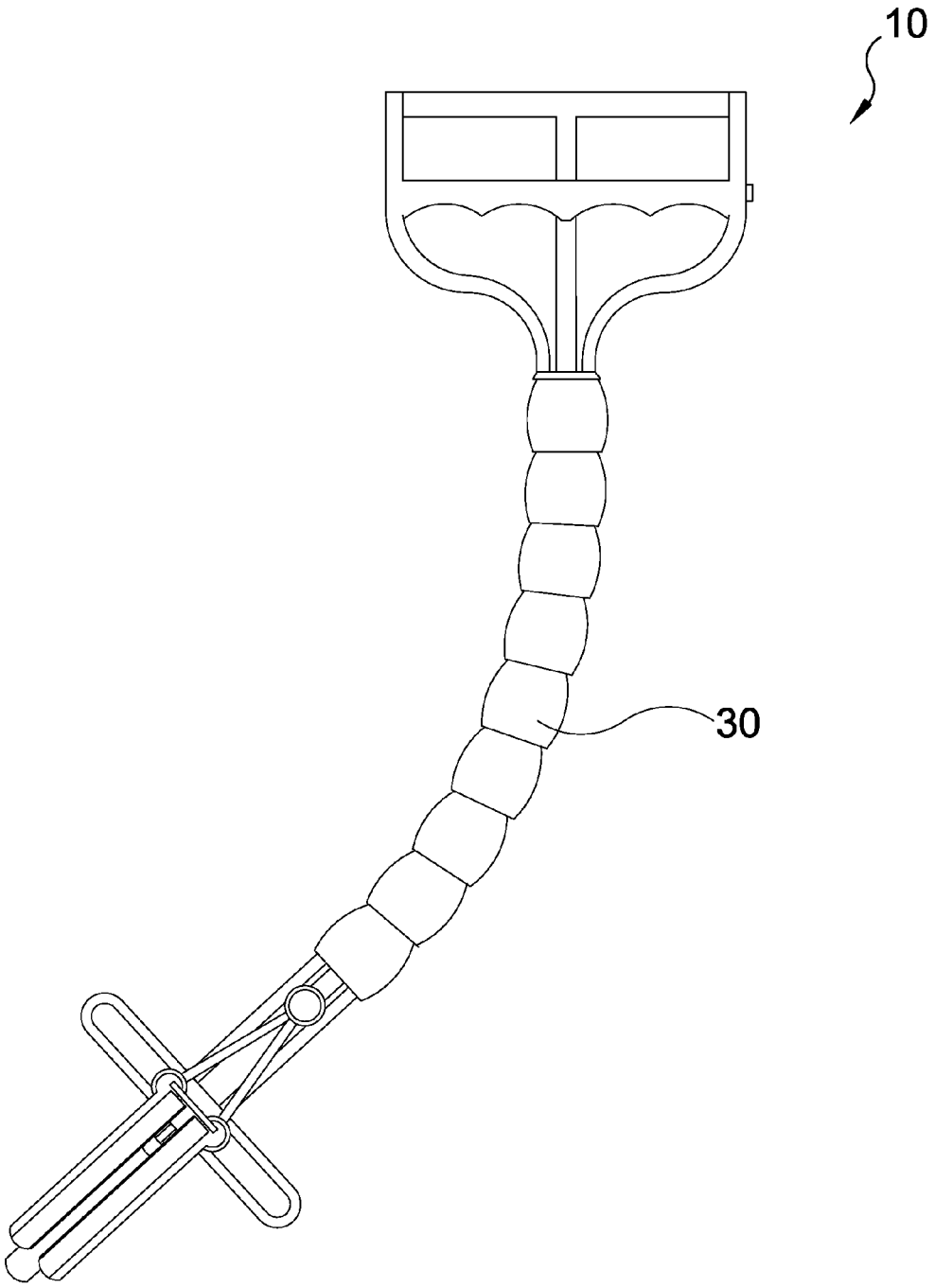
FIG. 4 is a front view of the present invention.

FIG. 4 is a front view of the present invention 10. Shown is the present invention 10 having an elongated form with an extending flexible central portion 30 that is positionable while functional in delivering the working end of the device to a region of one's body that would otherwise be inaccessible with a straight form device.

Figure 5:
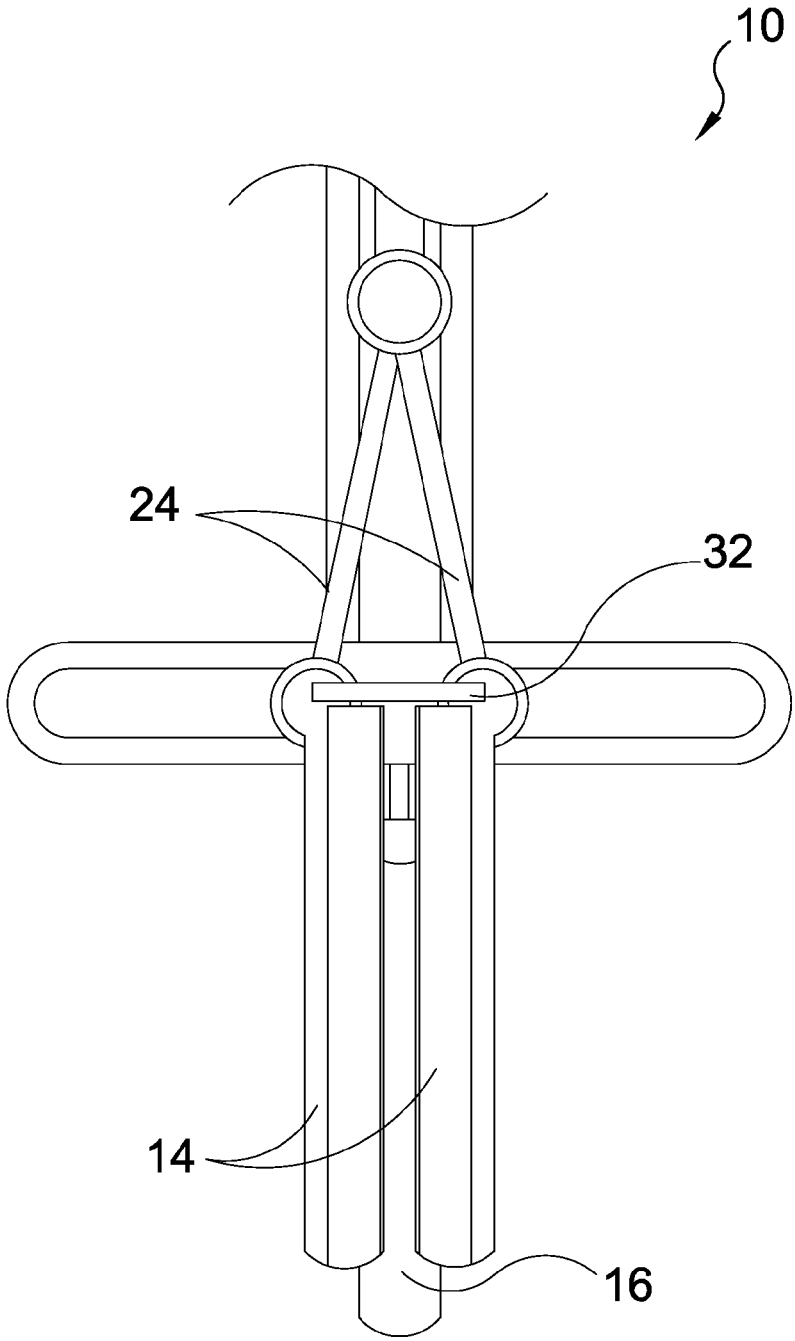
FIG. 5 is a detailed front view of the present intention.

FIG. 5 is a detailed front view of the present invention 10. Shown is a detailed view of the spreader elements 14 and elongated wiping elements 16 in the closed and retracted position. A fecal barrier 32 is provided proximal to the linkage 24.

Figure 6:
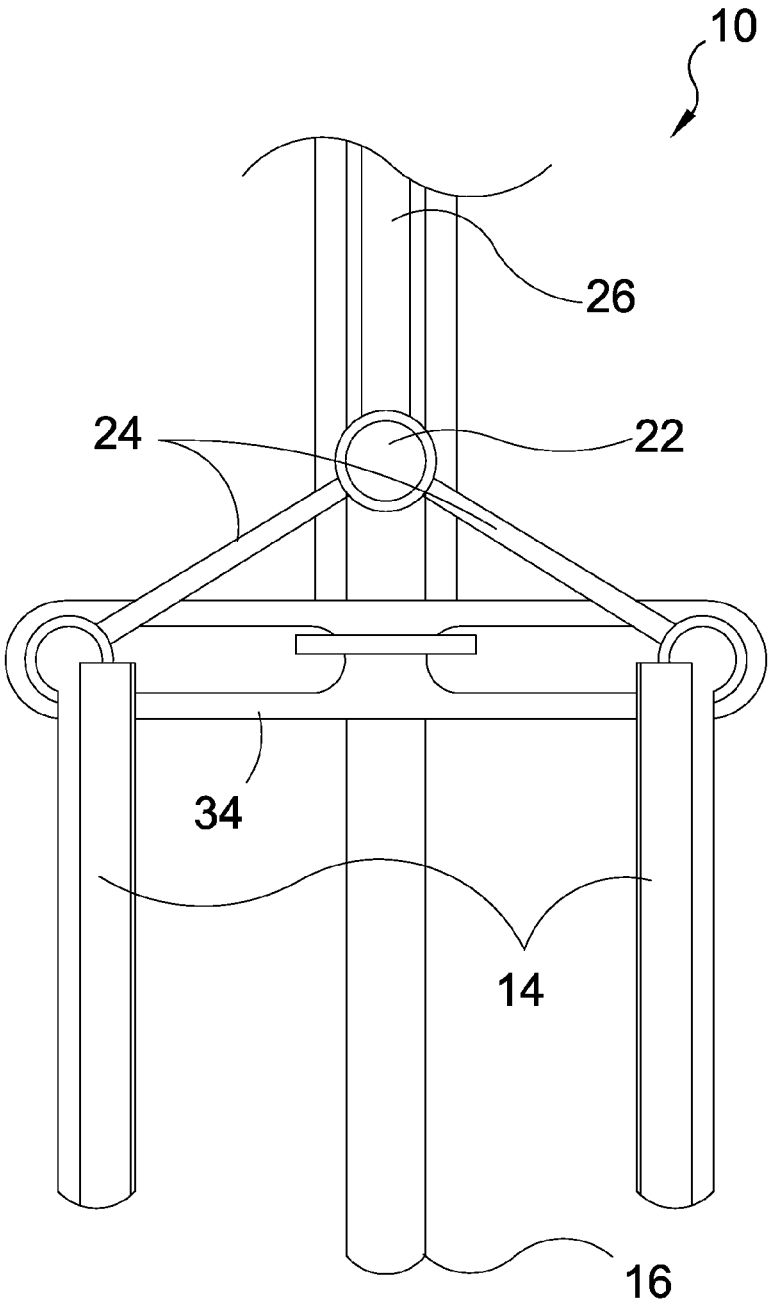
FIG. 6 is a detailed front view of the present invention.

FIG. 6 is a detailed front view of the present invention 10. Shown is a detailed view of the spreader elements 14 and elongated wiping element 16 of the present invention in the open and spread position. To operate the device the user squeezes the handle to force a displacement element 16 downward to cause the pivot point 22 to urge the linkages 24 to spread along a linkage track 34 and push the two spreader elements 14 outward to complete a spreading action.

Figure 7:
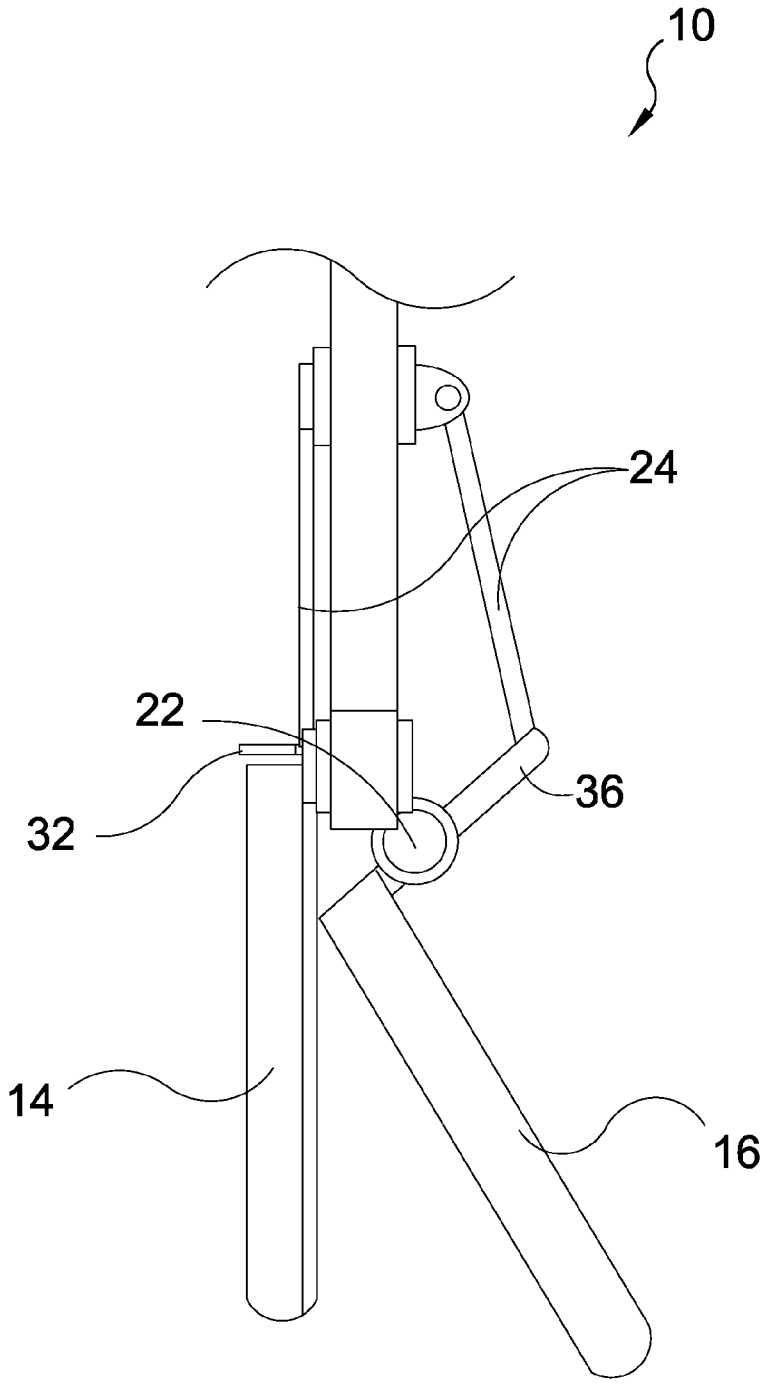
FIG. 7 is a detailed side view of the present invention.

FIG. 7 is a detailed side view of the present invention 10. Shown is a detailed side view of the present invention depicting that when the handle is not activated the elongated element 16 is held backward and out of one's way until the spreader elements 14 are engaged when the linkage 24 and lever 36 act upon the pivot point 22. A fecal barrier 32 is utilized to prevent the spread of fecal matter from the anus to the genitals during use.

Figure 8:
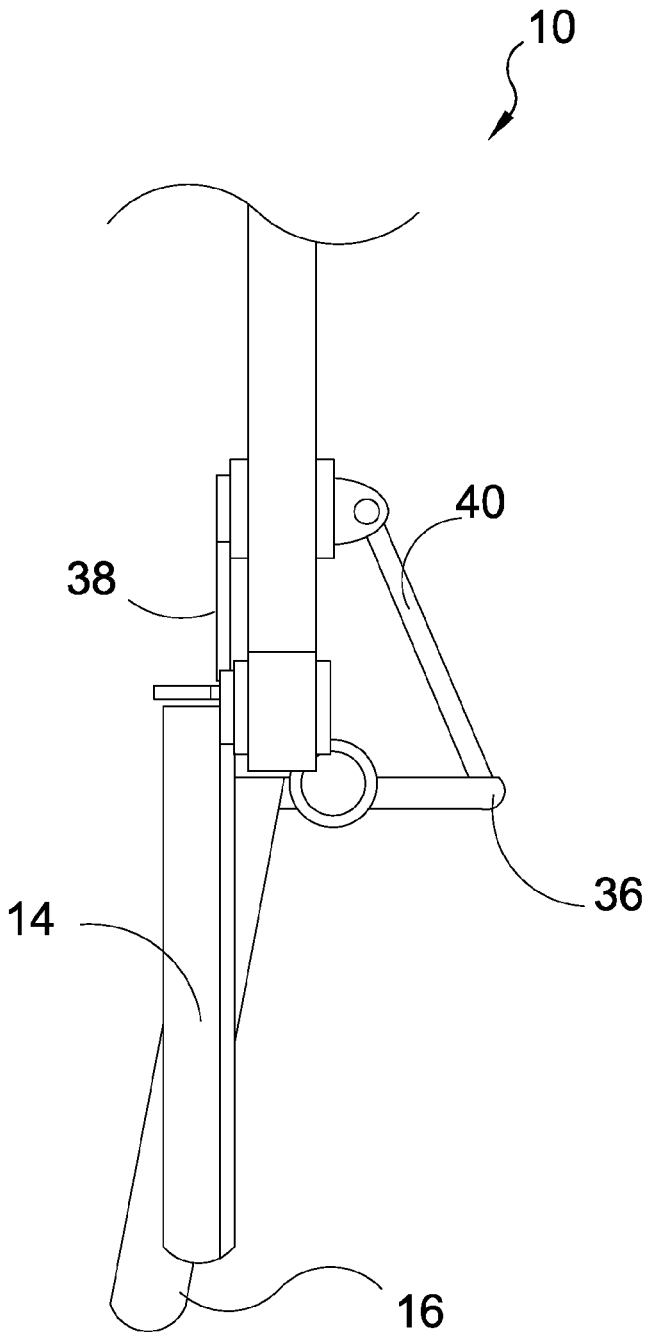
FIG. 8 is a detailed side view of the present invention.

FIG. 8 is a detailed side view of the present invention 10. Shown is a detailed side view of the present invention 10 depicting that when the handle is depressed the spreader linkage 38 cooperates with a wiper linkage 40 to operate with a lever 36 action to bring the elongated wiping element 16 forward and in between the spreader elements 14 simultaneously as they spread.

Figure 9:
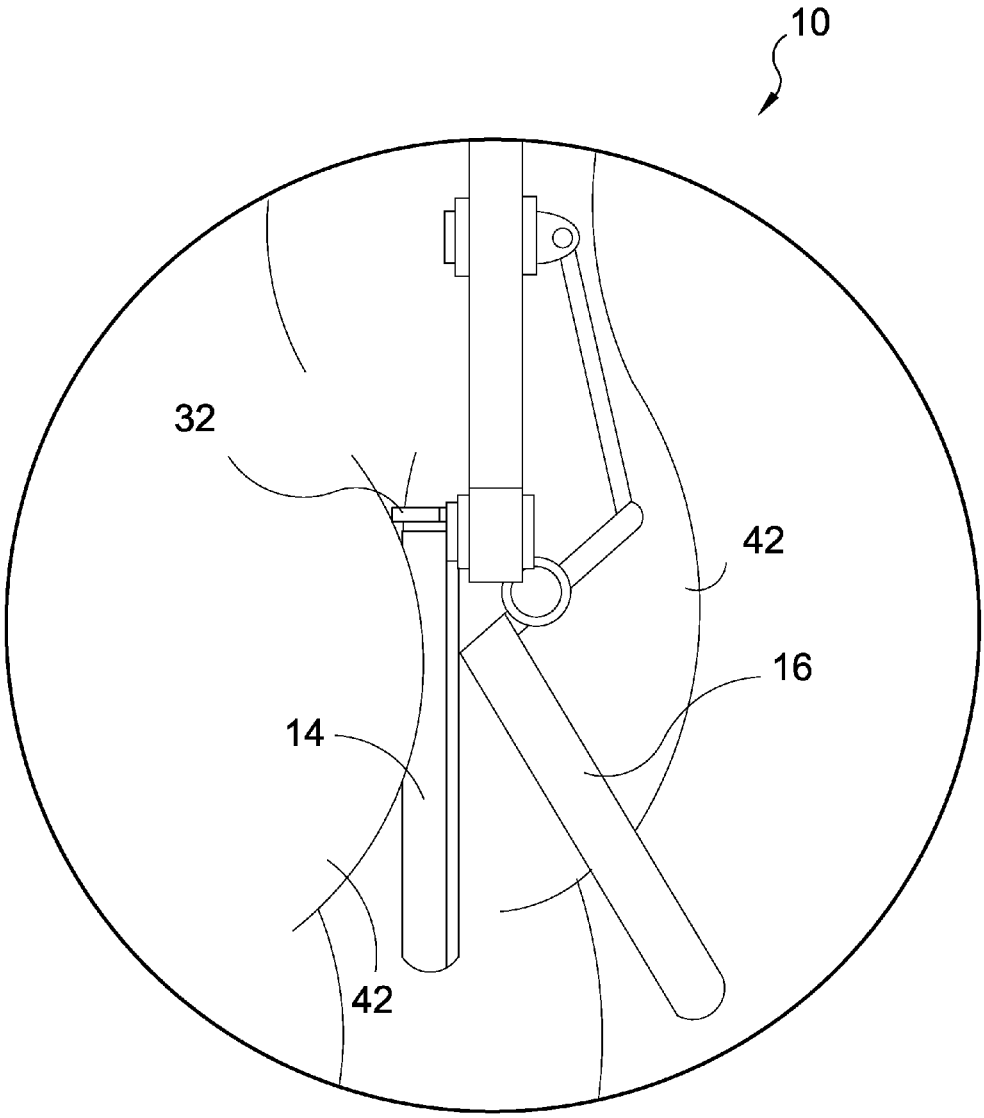
FIG. 9 is a detailed side view of the present invention in use.

FIG. 9 is a detailed side view of the present invention 10 in use. Shown is a detailed side view of the present invention in use showing that when using the device first the spreader elements 14 are inserted between the buttock's cheeks 42 wherethen the user would next engage the handle to initiate separation of the spreaders 14 and advancement of the wiper element 16. The fecal barrier 32 prevents the spread of fecal material.

Figure 10:
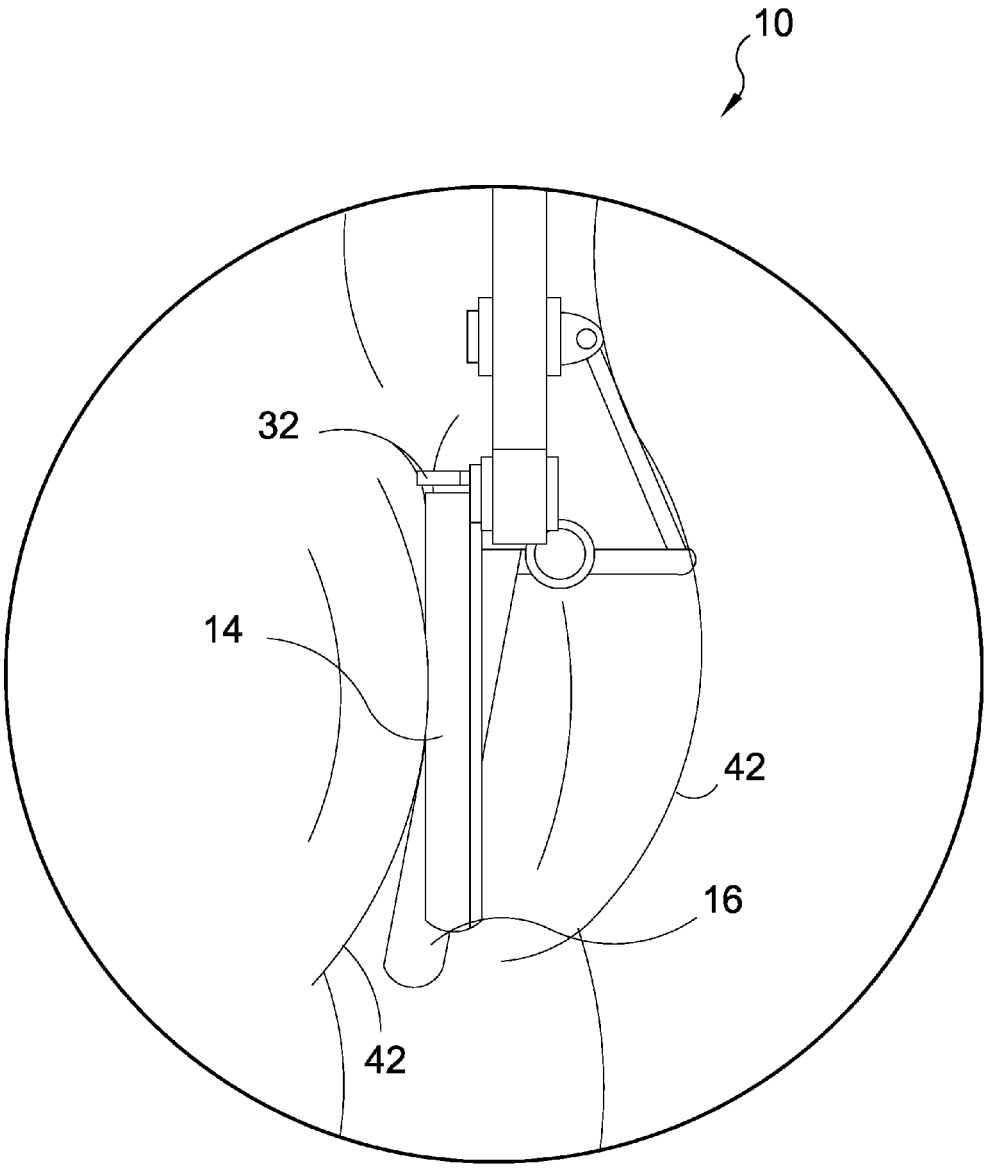
FIG. 10 is a detailed side view of the present invention in use.

FIG. 10 is a detailed side view of the present invention 10 in use. Shown is a detailed side view of the present invention in use showing that when using the device first the spreader elements 14 are inserted between the buttock's cheeks 42 wherethen the user would next engage the handle to initiate separation of the spreaders 14 and advancement of the wiper element 16. The fecal barrier 32 prevents the spread of fecal material.

Figure 11:
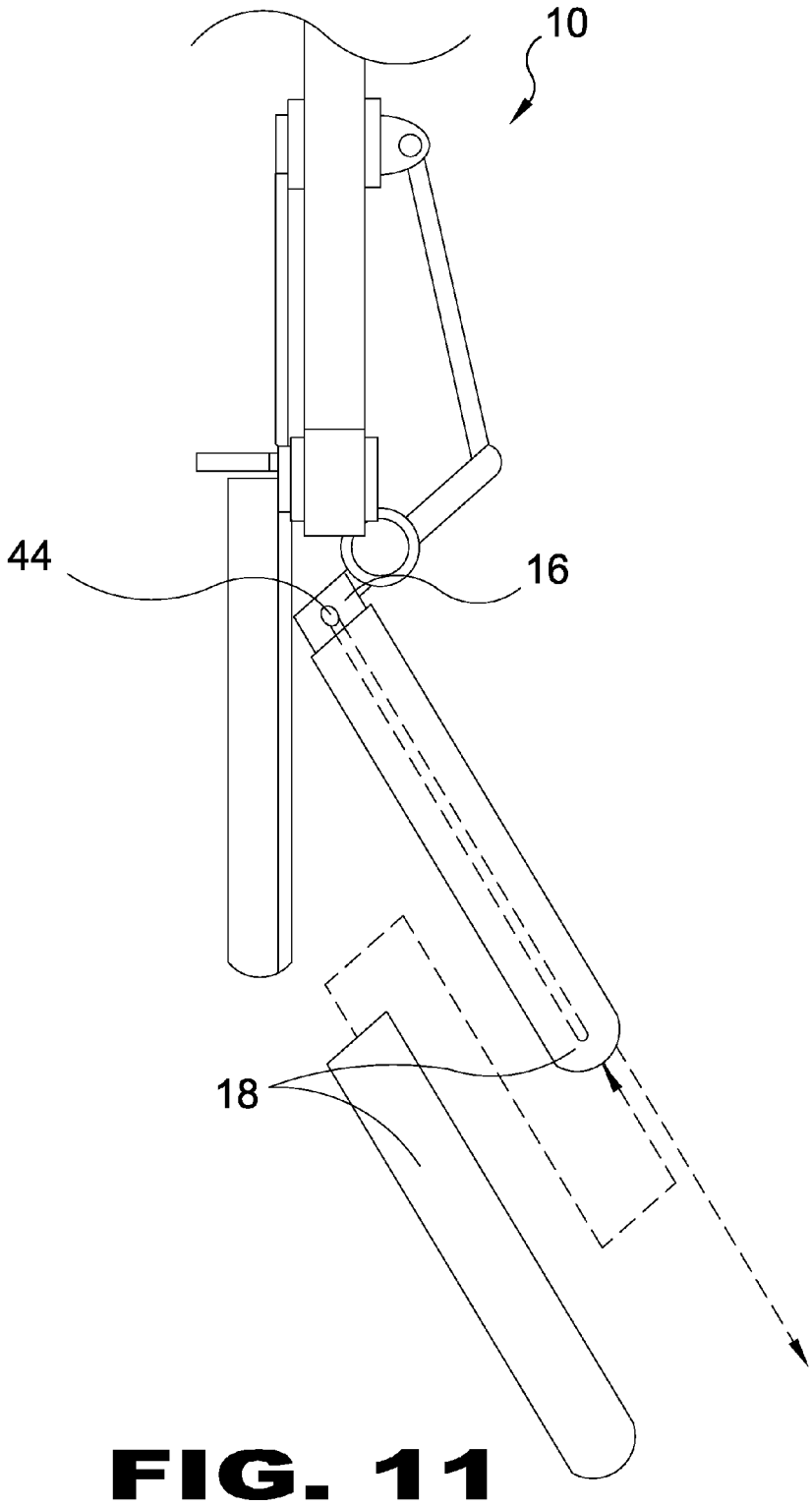
FIG. 11 is a detailed side view of the wiping element of the present invention.

FIG. 11 is a detailed side view of the wiping element of the preset invention 10. Shown is a detailed side view of the elongated wiping element 16 of the present invention having a disposable sleeve 18 composed of an absorbent fibrous material that slips over said elongated element 16 to make change and use of the wiping material quick and easy. A slidable sleeve removal tab 44 is provided to facilitate removal of the sleeve 18 therefrom.

Figure 12:
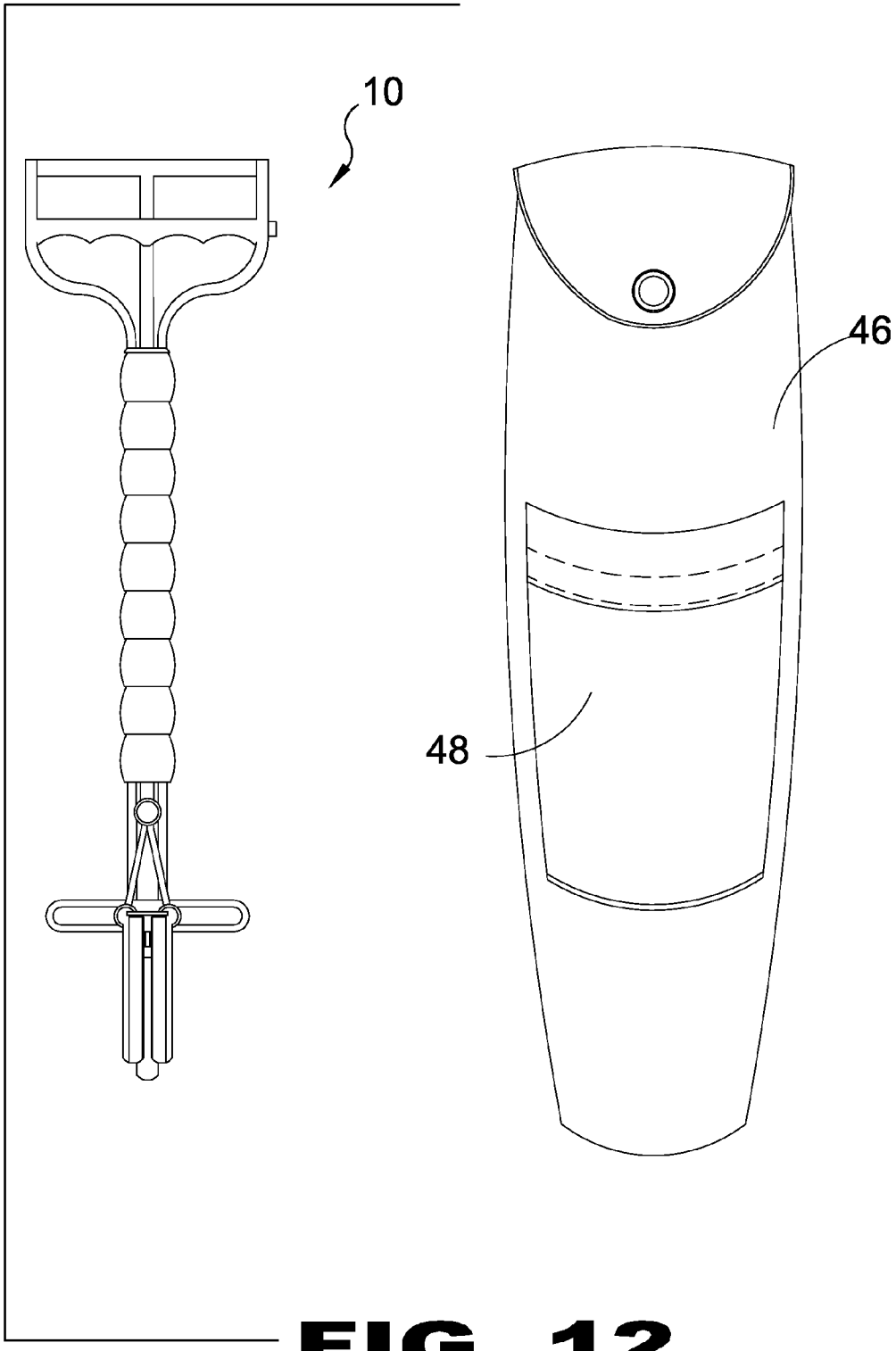
FIG. 12 is a front view of an additional element of the present invention.

FIG. 12 is a front view of an additional element of the present invention 10. Shown is an additional element of the present invention whereby a case 46 for carrying and storing of the device is provided. Additionally the case of the present invention may have an additional storage pocket 48 for storing additional replaceable sleeves along with the device until needed.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

The invention claimed is:

1. A personal hygiene device for simultaneously spreading buttocks and providing a wiping motion to the anus of the user, said personal hygiene device comprising:

a) a pair of spreader elements;

b) an elongate wiper element disposed between said spreader elements;

c) a handle to initiate separation of said spreader elements and the forward movement of said wiper element; and d) a flexibly positionable mid-portion communicating between said handle and said wiper and spreaders.

2. The personal hygiene device recited in claim 1, wherein said handle comprises a lower stationary handle and an upper displacement handle that actuates the device when a bias is applied to said displacement handle to urge it towards said stationary handle.

3. The personal hygiene device recited in claim 2, wherein said displacement handle acts upon a displacement element extending through said positionable mid-portion to communicate with said spreaders and said wiper element.

4. The personal hygiene device recited in claim 3, wherein said displacement element is in communication with a spreader linkage which determines the spatial relationship of said spreader elements depending on the action of said displacement element.

5. The personal hygiene device recited in claim 4, wherein said spreader elements traverse along a spreader track according to the action of said displacement element to separate the buttocks of the user.

6. The personal hygiene device recited in claim 3, wherein said displacement element is in communication with a wiper linkage that advances said wiper element towards the user's anus when actuated.

7. The personal hygiene device recited in claim 1, wherein a disposable wiper sleeve is slid onto said wiper element prior to use to extract fecal material from said anus.

8. The personal hygiene device recited in claim 7, wherein said wiper element further comprises a slidable sleeve removal tab to provide for hygienic removal of said sleeve therefrom.

9. The personal hygiene device recited in claim 1, wherein said handle further comprises a locking mechanism to lock said handle and respective spreaders in a desired open position to facilitate manipulation of the device when in use.

10. The personal hygiene device recited in claim 1, further comprising a fecal barrier to prevent the spread of fecal matter from the anus to the genitals while performing a sweeping or wiping procedure.

11. The personal hygiene device recited in claim 1, wherein said positionable mid-portion is flexible to enable the user to bend it accordingly to an angle best suited for the user to wipe the buttocks.

12. The personal hygiene device recited in claim 7, further comprising a storage case for storing said device when not in use.

13. The personal hygiene device recited in claim 12, wherein said storage case includes a securable storage pocket for storing said disposable wiper sleeves therein.

14. A method for using a personal hygiene device for separating a user's buttocks and wiping the anus comprising sequentially following the steps of:

a) providing the personal hygiene device of claim 1, and placing a disposable wiper sleeve over the wiper element;

b) bending the flexibly positionable mid-portion to provide an appropriate angle for application between the buttocks;

c) placing the spreader elements between the buttocks;

d) depressing a displacement handle to urge a displacement element downward through said mid-portion to simultaneously engage a spreader linkage to separate said spreaders and the respective buttocks and a wiper linkage to advance said wiper element to the anus;

e) depressing a handle lock button to lock the handle and associated spreader elements in an open position;

f) performing a wiping motion to remove fecal matter from said anus;

g) unlocking said handle lock to draw said spreaders back toward one another;

h) removing said device from the buttocks; and i) removing said wiper sleeve from said wiper element with a slidable sleeve removal tab.

* * * * *